US005948235A

United States Patent [19]

Arai

[11] Patent Number: 5,948,235

[45] Date of Patent: Sep. 7, 1999

[54] TIN-SILVER ALLOY PLATING BATH AND PROCESS FOR PRODUCING PLATED OBJECT USING THE PLATING BATH

[75] Inventor: Susumu Arai, Okaya, Japan

[73] Assignees: Naganoken; Shinko Electric Industries Co., Ltd., both of Nagano, Japan

[21] Appl. No.: 08/945,793

[22] PCT Filed: Mar. 3, 1997

[86] PCT No.: PCT/JP97/00644

§ 371 Date: Nov. 4, 1997

§ 102(e) Date: Nov. 4, 1997

[87] PCT Pub. No.: WO97/33015

PCT Pub. Date: Sep. 12, 1997

[30] Foreign Application Priority Data

Mar. 4, 1996 [JP] Japan ..... 8-075115

[51] Int. Cl.[6] ..... C25D 3/30

[52] U.S. Cl. ..... 205/252; 205/241; 106/1.25; 106/1.27

[58] Field of Search ..... 205/239, 241, 205/252, 253, 254, 263, 125; 106/1.25, 1.27

[56] References Cited

U.S. PATENT DOCUMENTS

| | | | |
|---|---|---|---|
| 5,674,374 | 10/1997 | Sakurai et al. | 205/253 |
| 5,711,866 | 1/1998 | Lashmore et al. | 205/687 |
| 5,759,381 | 6/1998 | Sakurai et al. | 205/253 |

*Primary Examiner*—Kishor Mayekar

[57] ABSTRACT

In the present invention, the tin-silver-system alloy plating solution comprising following five fundamental ingredients (a)–(e): (a) a tin compound; (b) a silver compound; (c) at least one member selected from a group consisting of bismuth compounds and copper compounds; (d) a pyrophosphoric compound; and (e) an iodic compound. By the present invention, the tin-silver-system alloy layer, which can be employed instead of tin-lead solder alloy layer, can be formed without using harmful compounds: cyanide, lead compounds, etc..

16 Claims, No Drawings

TIN-SILVER ALLOY PLATING BATH AND PROCESS FOR PRODUCING PLATED OBJECT USING THE PLATING BATH

FIELD OF TECHNOLOGY

The present invention relates to plating solution, in which tin-silver-system alloy having lower melting point is made, and a method of plating in said plating solution.

BACKGROUND OF THE INVENTION

Pollution of underground water by lead has been taken as an environmental pollution these days, and products including lead are severely restricted, so that tin-lead solder is replaced by lead-free solder. Thus, plating layers coated with the tin-lead solder should be replaced by the lead-free solder.

Tin-silver-system alloy will be employed instead of the tin-lead solder alloy, so Matsushita Electric Company disclosed tin-silver solder paste (see Nikkei Sangyo Press, Feb. 1, 1996). A method of forming the tin-silver solder layer is required now. But difference of electrodeposition potential between silver and tin is 900 mV or more as standard oxidation-reduction potential, the cyanide, e.g., potassium cyanide, is included in plating solution so as to codeposite tin and silver when forming the tin-silver alloy layer. With the cyanide, there are many problems of polluting waste water, safe work, etc., so the tin-silver plating solution including no cyanides is required.

On the other hand, alloys which are made by adding bismuth, copper, etc. to the tin-silver alloys have better soldering characteristics, so the tin-silver-system alloy plating solution has been required.

An object of the present invention is to provide the tin-silver-system alloy plating solution, which is capable of being employed instead of the tin-lead alloy plating solution, including no cyanides.

DISCLOSURE OF THE INVENTION

To achieve the object, the tin-silver-system alloy plating solution of the present invention comprises following five fundamental ingredients (a)–(e):

(a) a tin compound;

(b) a silver compound;

(c) at least one member selected from a group consisting of bismuth compounds and copper compounds;

(d) a pyrophosphoric compound; and (e) an iodic compound.

In the tin-silver-system alloy plating solution, the pyrophosphoric compound may include pyrophosphate and/or pyrophosphoric acid.

In the tin-silver-system alloy plating solution, the iodic compound may include iodide, iodite and/or iodine.

In the tin-silver-system alloy plating solution, the tin compound may include a tin compound of inorganic acid or a tin compound of organic acid.

In the tin-silver-system alloy plating solution, the silver compound may include a silver compound of inorganic acid or a silver compound of organic acid.

In the tin-silver-system alloy plating solution, the bismuth compound may include a bismuth compound of inorganic acid or a bismuth compound of organic acid.

In the tin-silver-system alloy plating solution, the copper compound may include a copper compound of inorganic acid or a copper compound of organic acid.

In the tin-silver-system alloy plating solution, prescribed amount of the pyrophosphoric compound and the iodic compound may be included so as to exist tin, silver, bismuth and copper, as complex ions, in the plating solution.

Next, the method of electrolytic plating of the present invention is characterized in that plating solution is tin-silver-system alloy plating solution comprising following five fundamental ingredients (a)–(e):

(a) a tin compound;

(b) a silver compound;

(c) at least one member selected from a group consisting of bismuth compounds and copper compounds;

(d) a pyrophosphoric compound; and (e) an iodic compound.

Further, the method of plating of the present invention comprises the steps of: forming a resin layer on a surface of a work; forming the resin layer into a prescribed pattern as a plating mask; and executing electrolytic plating on the surface of the work in tin-silver-system alloy plating solution comprising following five fundamental ingredients (a)–(e):

(a) a tin compound;

(b) a silver compound;

(c) at least one member selected from a group consisting of bismuth compounds and copper compounds;

(d) a pyrophosphoric compound; and (e) an iodic compound.

In this method, the resin layer may be a layer of photosensitive resin, and the photosensitive resin layer may be formed into the prescribed pattern by a manner of photolithograph.

In the methods, the pyrophosphoric compound may include pyrophosphate and/or pyrophosphoric acid.

In the methods, the iodic compound may include iodide, iodite and/or iodine.

In the methods, the tin compound may include a tin compound of inorganic acid or a tin compound of organic acid.

In the methods, the silver compound may include a silver compound of inorganic acid or a silver compound of organic acid.

In the methods, the bismuth compound may include a bismuth compound of inorganic acid or a bismuth compound of organic acid.

In the methods, the copper compound may include a copper of compound inorganic acid or a copper compound of organic acid.

THE BEST MODE OF THE INVENTION

In the tin-silver-system alloy plating solution of the present invention, the prescribed amount of pyrophosphate, which corresponds to the coordination number of the metal formed in the solution, is added so as to add pyrophosphoric acid ions to the metal, so that pyrophosphoric complex ions of the metal can be stabilized more. Preferably, the molarity of pyrophosphoric acid ions is two times the molarity or more with respect to tin and copper.

Pyrophosphate, e.g., potassium pyrophosphate, sodium pyrophosphate, and/or pyrophosphoric acid may be employed as a pyrophosphoric compound.

In the plating solution, amount of an iodic compound can be optionally changed within a range in which complex ions of silver and bismuth can be stably exist; density of iodine ions ($I^-$) is made 0.5 mol/l or more so as to stabilize the complex ions of iodic compound of the metal more. Preferably, the density of iodine ions ($I^-$) is 1.5 mol/l or more.

Iodide, e.g., potassium iodide, sodium iodide, iodite, e.g., potassium iodite, sodium iodite, and iodine may be solely employed as the iodic compound; mixture of two or more may be employed as the iodic compound.

In the tin-silver-system alloy plating solution, tin compounds are not limited, so a tin compound of inorganic acid or a tin compound of organic acid such as tin chloride, tin chloride 2 hydrate, tin sulfate, tin pyrophosphate, stannic acid, tin methanesulfonate, can be solely or jointly added as the tin compounds.

In the tin-silver-system alloy plating solution, silver compounds are not limited; a silver compound of inorganic acid or a silver compound of organic acid, e.g., silver iodide, silver chloride, silver nitrate, silver sulfate, silver methanesulfonate, can be solely or jointly added as the silver compounds.

In the tin-silver-system alloy plating solution, bismuth compounds are not limited; a bismuth compound of inorganic acid or a bismuth compound of organic acid, e.g., bismuth chloride, bismuth iodide, bismuth citrate, can be solely or jointly added as the bismuth compounds.

In the tin-silver-system alloy plating solution, copper compounds are not limited; a copper compound of inorganic acid or a copper compound of organic acid, e.g., copper (I) chloride, copper (II) chloride, copper sulfate, copper pyrophosphate, copper carbonate, copper nitrate, can be solely or jointly added as the copper compounds.

Blending ratio of the silver compounds and the tin compounds in the tin-silver-system alloy plating solution may be changed optionally. And, blending ratio of the member or members selected from the group consisting of bismuth compounds and copper compounds may be changed optionally. In the case of making an alloy having lower melting point, the blending ratio of the tin compounds should be greater than that of others.

The pH of the plating solution can be adjusted by adding acid, e.g., pyrophosphoric acid, hydrochloric acid, or alkali, e.g., potassium hydroxide, sodium hydroxide. The favorite pH is 5–10, but it may be in a pH range in which the plating solution does not change in quality.

Further, complexing agents, brightener, surface-active agents, etc. may be added to the tin-silver-system alloy plating solution.

Oxalate, tartrate, citrate, glycine, sulfite, thiosulfate, etc. may be added as the complexing agents.

Peptone, β-naphthol, aminoaldehyde, formaldehyde, acetaldehyde, polyethylene glycol, methyl acrylate, salicylic acid, salicylic acid derivative, N,N'-dimethylformamide, hexaethylenetetraamine, malonic acid, etc. may be solely or jointly added as the brightener.

Especially, L-ascorbic acid, phenol, hydroquinone, resorcin, etc. may be solely or jointly added as an antioxidant for the tin.

Sodium lauryl sulfate, polyoxyethylenenonyphenylether, benzalkonium chloride, etc. may be solely or jointly added as the surface-active agents.

Ordinary electroplating manners can be executed in the tin-silver-system alloy plating solution. For example, pulse plating and periodical reverse current plating can be executed in the plating solution. For example, the plating may be executed under the following conditions: temperature of the plating solution is 20–80° C.; the solution is stirred or not stirred; galvanostatic or potentiostatic electrolysis. For example, tin, silver, copper, tin-silver alloy, tin-silver-copper alloy, tin-silver-bismuth alloy, platinum, titanium plated with platinum, carbon may be used as an anode.

Works to be plated are not limited, any materials which are capable of being electrically plated may be employed as the works.

EMBODIMENTS

Embodiments of the present invention will be explained, but the present invention is not limited to the following some embodiments, and composition of the plating solution may be optionally changed according to purposes.

Embodiment 1

| | |
|---|---|
| $Sn_2P_2O_7$ | 21 g/l |
| $K_4P_2O_7$ | 66 g/l |
| AgI | 0.5 g/l |
| KI | 330 g/l |
| $BiI_3$ | 3 g/l |

The tin-silver-bismuth alloy plating solution includes above described ingredients. The pH number is adjusted to 4 by adding pyrophosphoric acid. Pure copper substrates are electroplated in the plating solution under the conditions of: temperature 25° C.; no stir; and cathodic current density 0.7 A/dm$^2$. By the plating, tin-silver-bismuth alloy layers, which include 83% of tin, 3.5% of silver and 13.5% of bismuth, can be formed on the substrates.

Solderability test of the copper substrates, which are plated with the tin-silver-bismuth alloy, are executed, by a solder checker (type: SAT-2000 made by Rhesca Corporation), under the conditions of: tin-silver solder (including 3.5 WT % of silver); temperature 250° C.; 30%-WW rosin or no rinse type flux. As the result of the test, the plated layer have good solderability without dewetting of soft solder.

Embodiment 2

| | |
|---|---|
| $Sn_2P_2O_7$ | 21 g/l |
| $K_4P_2O_7$ | 66 g/l |
| AgI | 0.5 g/l |
| KI | 330 g/l |
| $CuP_2O_7$ | 0.5 g/l |

The tin-silver-copper alloy plating solution includes above described ingredients. The plating solution is transparent and blue solution; the pH number is 9.0; an external appearance of the plating solution has been kept for two weeks. Pure copper substrates are electroplated in the plating solution under the conditions of: temperature 25° C.; no stir; and cathodic current density 0.5 A/dm$^2$ and 1 A/dm$^2$. By the plating with the cathodic current density 0.5 A/dm$^2$, tin-silver-copper alloy layers, which include 78% of tin, 18% of silver and 4% of copper, can be formed on the substrates; by the plating with the cathodic current density 1 A/dm$^2$, the alloy layers, which include 94% of tin, 5% of silver and 1% of copper, can be formed on the substrates.

Solderability test of the copper substrates, which are plated with the tin-silver-copper alloy, are executed, by the solder checker (type: SAT-2000 made by Rhesca Corporation), under the conditions of: tin-silver solder (including 3.5 WT % of silver); temperature 250° C.; 30%-WW rosin or no rinse type flux. As the result of the test, the plated layer have good solderability without dewetting of soft solder.

Embodiment 3

| | |
|---|---|
| $Sn_2P_2O_7$ | 103 g/l |
| $K_4P_2O_7$ | 330 g/l |
| AgI | 1.2 g/l |
| KI | 332 g/l |
| $CuP_2O_7$ | 1.2 g/l |

The tin-silver-copper alloy plating solution includes above described ingredients. The plating solution is transparent and blue solution; the pH number is 9.0; an external appearance of the plating solution has been kept for six months without deposition, etc. Pure copper substrates are electroplated in the plating solution under the conditions of: temperature 25° C.; no stir; and cathodic current density 0.2–2 A/dM$^2$. Composition of the tin-silver-copper layers (amount of silver and copper: WT %) and external appearances thereof (○ is gray and no glossy; and ◎ is gray and half glossy), with respect to each current density, are shown in TABLE 1.

TABLE 1

| Current Density (A/dm$^2$) | 0.2 | 0.5 | 0.8 | 1 | 1.5 | 2 |
|---|---|---|---|---|---|---|
| Amount of Silver (WT %) | 8.4 | 4.4 | 3.0 | 2.6 | 2.2 | 1.5 |
| Amount of Copper (WT %) | 6.3 | 3.1 | 2.1 | 1.7 | 1.6 | 1.1 |
| External Appearance | ○ | ◎ | ○ | ○ | ○ | ○ |

Solderability test of the copper substrates, which are plated with the tin-silver-copper alloy, are executed, by the solder checker (type: SAT-2000 made by Rhesca Corporation), under the conditions of: tin-silver solder (including 3.5 WT % of silver); temperature 250° C.; 30%-WW rosin or no rinse type flux. As the result of the test, the plated layer have good solderability without dewetting of soft solder.

Embodiment 4

Melting points of the tin-silver-copper alloy layers are measured by a thermal analyzer (DSC); the measured melting points or temperature of starting to melt of all layers are 217° C.

Embodiment 5

A photo-sensitive resin film (a resist film layer), whose thickness is about 25 μm, is formed on a pure copper substrate, then 50 rows and lines of holes, namely 2500 holes, each of which has diameter of 100 μm, and which are longitudinally and latitudinally arranged with the space of 100 μm, are bored in the resist film layer by a manner of photo-lithograph, so that the copper surfaces are exposed as inner bottom faces of the holes. The tin-silver-bismuth alloy layers having about thickness of 25 μm are formed on the exposed copper surfaces under the conditions of: using the alloy plating solution of the Embodiment 1; the current density 1.5 A/dm$^2$; no stir; and temperature 25° C. After forming the alloy layers, the resist film layer is removed, then the plated parts (the tin-silver-bismuth alloy parts) are observed by an electron microscope; the alloy layers are correctly formed along inner shapes of the holes. Composition of the alloy layers are analyzed by an electron probe X-ray micro analyzer; the alloy layers include 83% of tin, 3.5% of silver and 13.5% of bismuth, and the thickness of the alloy layers are almost equal.

Note that, non-photo-sensitive resist film layer may be employed. In this case, the resist film layer may be formed into desired patterns by laser, e.g., excimer laser.

Embodiment 6

A photo-sensitive resin film (a resist film layer), whose thickness is about 25 μm, is formed on a pure copper substrate, then 50 rows and lines of holes, namely 2500 holes, each of which has diameter of 100 μm, and which are longitudinally and latitudinally arranged with the space of 100 μm, are bored in the resist film layer by a manner of photo-lithograph, so that the copper surfaces are exposed as inner bottom faces of the holes. Firstly, the exposed surfaces are plated with nickel whose thickness is about 5 μm, then they are electroplated in the tin-silver-copper alloy plating solution of the Embodiment 2 under the conditions of the Embodiment 2. After forming the alloy layers, the resist film layer is removed, then the plated alloy parts are observed by the electron microscope; the alloy layers are made thicker than the resist film layer, and they are formed like mushrooms (diameter of the parts projected from the surface of the resist film layer are greater than that of the holes). The mushroom-shaped alloy layers are melted in hydrogen atmosphere, so that they are formed into hemispheres having the diameter of 100 μm and the height of 70 μm. The hemispherical alloy is analyzed by the electron probe X-ray micro analyzer; tin, silver and copper are uniformly distributed in the hemispherical alloy.

Note that, non-photo-sensitive resist film layer may be employed. In this case, the resist film layer may be formed into desired patterns by laser, e.g., excimer laser.

EFFECTS OF THE INVENTION

In the plating solution of the present invention, the tin-silver-system alloy layer, which is expected to be quite useful solder alloy substitute for the tin-lead solder alloy layer, can be formed without using any cyanides.

I claim:

1. A tin-silver-system alloy plating solution used in the electrodeposition of a tin-silver-system alloy in an article with a high current efficiency and without using a cyanide material, said plating solution comprising tin ions, silver ions, at least one member selected from a group consisting of bismuth ions and copper ions, a pyrophosphoric compound and an iodic compound, wherein said pyrophosphoric compound and an iodic compound are presented in an amount sufficient to perform a soluble complex with ions of tin, silver, bismuth and copper.

2. The tin-silver-system alloy plating solution according to claim 1, wherein said pyrophosphoric compound includes pyrophosphate, pyrophosphoric acid, or a combination thereof.

3. The tin-silver-system alloy plating solution according to claim 1, wherein said iodic compound includes iodide, iodite, iodine, or a combination thereof.

4. The tin-silver-system alloy plating solution according to claim 1, wherein said tin compound includes a tin compound of inorganic acid or a tin compound of organic acid.

5. The tin-silver-system alloy plating solution according to claim 1, wherein said silver compound includes a silver compound of inorganic acid or a silver compound of organic acid.

6. The tin-silver-system alloy plating solution according to claim 1, wherein said bismuth compound includes a bismuth compound of inorganic acid or a bismuth compound of organic acid.

7. The tin-silver-system alloy plating solution according to claim 1, wherein said copper compound includes a copper compound of inorganic acid or a copper compound of organic acid.

8. A method of plating, comprising the steps of:

forming a resin layer on a surface of a work;

forming the resin layer into a prescribed pattern as a plating mask; and executing electrolytic plating on the surface of the work in tin-silver-system alloy plating solution comprising following five fundamental ingredients (a)–(e):

(a) a tin compound;

(b) a silver compound;

(c) at least one member selected from a group consisting of bismuth compounds and copper compounds;

(d) a pyrophosphoric compound; and (e) an iodic compound.

9. The method of plating according to claim 8, wherein the resin layer is a layer of photosensitive resin, and the photosensitive resin layer is formed into the prescribed pattern by a manner of photolithography.

10. The method of plating according to claim 8, wherein said pyrophosphoric compound includes pyrophosphate, iodine, or a combination thereof.

11. The method of plating according to claim 8, wherein said iodic compound includes iodine, iodite, or a combination thereof.

12. The method of plating according to claim 7, wherein said tin compound includes a tin compound inorganic acid or a tin compound of organic acid.

13. The method of plating according to claim 7, wherein said silver compound includes a silver compound inorganic acid or a silver compound of organic acid.

14. The method of plating according to claim 7, wherein said bismuth compound includes a bismuth compound inorganic acid or a bismuth compound of organic acid.

15. The method of plating according to claim 7, wherein said copper compound includes a copper compound inorganic acid or a copper compound of organic acid.

16. A method of electrolytic plating which comprises electrodepositing a tin-silver-system alloy on an article from a plating solution containing a tin compound, a silver compound, at least one member selected from a group consisting of bismuth compounds and copper compounds, and a complexing agent, containing a pyrophosphoric compound and an iodic compound, such that the article is plated with the tin-silver-system alloy.

* * * * *

UNITED STATES PATENT AND TRADEMARK OFFICE

CERTIFICATE OF CORRECTION

PATENT NO. : 5,948,235
DATED : September 7, 1999
INVENTOR(S) : Susumu Arai

It is certified that error appears in the above-identified patent and that said Letters Patent is hereby corrected as shown below:

Column 8,
Line 1, change "claim 7" to -- claim 8 --.
Line 1, change "claim 7" to -- claim 8 --.
Line 1, change "claim 7" to -- claim 8 --.
Line 1, change "claim 7" to -- claim 8 --.

Signed and Sealed this

Thirtieth Day of April, 2002

*Attest:*

*Attesting Officer*

JAMES E. ROGAN
*Director of the United States Patent and Trademark Office*